US008408761B2

(12) United States Patent
Ng et al.

(10) Patent No.: US 8,408,761 B2
(45) Date of Patent: Apr. 2, 2013

(54) ARTICULATING LAMP

(75) Inventors: Kenneth Ng, Monterey Park, CA (US); Edmund Ng, Monterey Park, CA (US)

(73) Assignee: Koncept Technologies, Inc., Monrovia, CA (US)

( * ) Notice: Subject to any disclaimer, the term of this patent is extended or adjusted under 35 U.S.C. 154(b) by 738 days.

(21) Appl. No.: 12/552,893

(22) Filed: Sep. 2, 2009

(65) Prior Publication Data

US 2011/0051437 A1 Mar. 3, 2011

(51) Int. Cl.
*F21S 8/00* (2006.01)

(52) U.S. Cl. ..... 362/427; 362/418; 362/419; 362/428

(58) Field of Classification Search ..... 362/418–456
See application file for complete search history.

(56) References Cited

U.S. PATENT DOCUMENTS 3,601,598 A * 8/1971 Horn ..... 362/418
7,896,568 B2 * 3/2011 Atkinson ..... 362/427

* cited by examiner

*Primary Examiner* — William Carter
(74) *Attorney, Agent, or Firm* — Steins & Associates, P.C.

(57) ABSTRACT

The lamp has a superior, sleek, aesthetic profile, while also providing robust functionality and articulation. The lamp includes at least one joint that combines the functionality of allowing an arm of the lamp to articulate and rotate, as well as allowing the joint to be pulled apart and plugged back together. Each articulating hinged or pivoting joint transmits electrical power between the adjoining members without the use of exposed wiring. There are a variety of structural options regarding the lamps base or attachment mechanism, including a weighted base, a clamp, a through-table mount, or a wall mount. Available versions of this sleek lamp include a variety of arm and joint configurations so that the lamp can serve a wide range of installations and applications, while using a standardized group of components.

19 Claims, 8 Drawing Sheets

ARTICULATING LAMP

BACKGROUND OF THE INVENTION

1. Field of the Invention

This invention relates generally to lighting fixtures and, more specifically, to an Articulating Lamp.

2. Description of Related Art

Lamps configured to rest on desks, tables and the like in order to provide localized utility lighting for work surfaces have been widely available for a number of years. Furthermore, in order to provide maximum lighting capability and utility, most of these lamps have a positionable arm extending from a base to a lighting assembly (at the arm's distal end). These days, the newest innovations for lighting products have come in the form of products utilizing LED light sources. LED's provide extraordinarily long life, bright, high quality light, and a substantially smaller form factor that lends itself to elegant, sleek lamp designs.

The conventional positionable or articulating desk lamp arm was made of a series of linkages interconnected by elbow-like joints. At the lighting assembly, a ball and socket-type joint allowed the lamps light to be trained in a variety of different directions by the user. The linkages usually included visible springs that provided the necessary tension so that the lamp arm could be hand-positioned, as desired, over the work surface. The springs and joints would then hold the arm in place until moved by the user.

While these prior forms of articulating or positionable desk lamps were functionally acceptable, they were not supremely pleasing from an aesthetic standpoint. Furthermore, the sleek designs now available using LED lights and modules seem to be mismatched with the old spring-loaded linkage design. A producer could create a very modern lighting assembly that would have its sleek aesthetics diminished substantially by the old fashioned arm design.

What is needed, then, is a desk-type lamp that has an articulating arm with at least the functionality of the prior spring-loaded designs, but with the advanced aesthetic properties made available through use of LED light assemblies.

SUMMARY OF THE INVENTION

In light of the aforementioned problems associated with the prior devices and systems, it is an object of the present invention to provide an Articulating Lamp. The lamp should present a superior, sleek, aesthetic profile, while also providing robust functionality and articulation. The lamp should include at least one joint that combines the functionality of allowing an arm of the lamp to articulate and rotate, as well as allowing the joint to be pulled apart and plugged back together. Each articulating, hinged or pivoting joint should transmit electrical power between the adjoining members without the use of exposed wiring. The lamp should have a variety of options regarding its base or attachment mechanism, including a weighted base, a clamp, a through-table mount or a wall mount. Versions of this sleek lamp should be available that include a variety of arm and joint configurations so that the lamp can serve a wide range of installations and applications, while using a standardized group of components.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, of which:

DETAILED DESCRIPTION OF THE PREFERRED EMBODIMENTS

The following description is provided to enable any person skilled in the art to make and use the invention and sets forth the best modes contemplated by the inventors of carrying out their invention. Various modifications, however, will remain readily apparent to those skilled in the art, since the generic principles of the present invention have been defined herein specifically to provide an Articulating Lamp.

Figure 1:
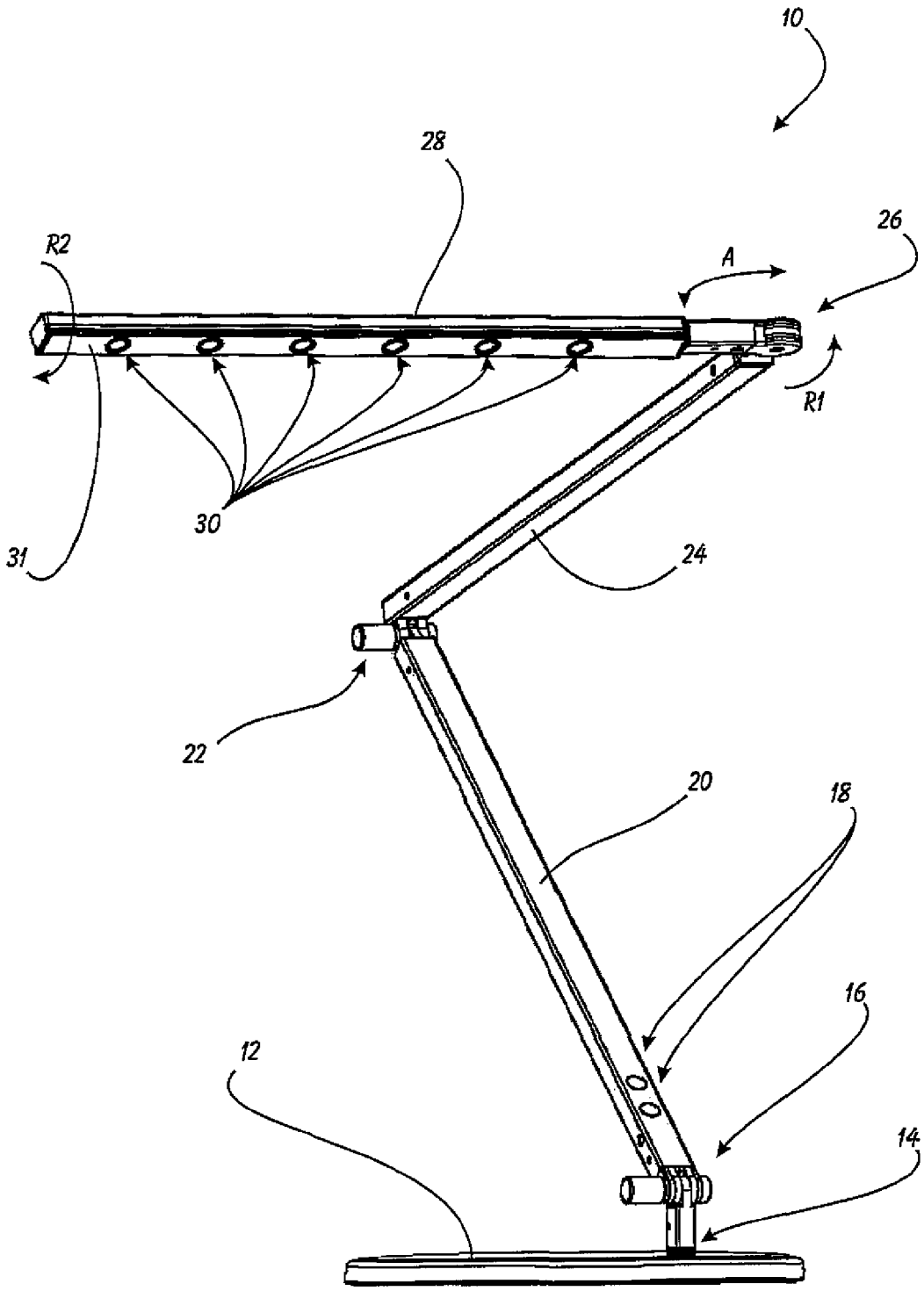
FIG. 1 is a perspective view of a preferred embodiment of the articulating lamp of the present invention.

The present invention can best be understood by initial consideration of FIG. 1. FIG. 1 is a perspective view of a preferred embodiment of the articulating lamp 10 of the present invention. As should be casually apparent, the lamp 10 has a clean, sleek shape that was previously unavailable from any manufacturer. Importantly, and as will be discussed further herein, the lamp 10 provides, and even exceeds the lighting quality and user functionality previously only available in conventional exposed spring desk lamps.

The lamp 10 rests atop a flat supporting surface at base 12. First rotating joint 14 extends upwardly from the base 12, and allows the lamp 10 arms to rotate around a generally vertical axis. In other designs, the base 12 could be configured differently (e.g. clamp, weight, etc.). Immediately adjacent to the first rotating joint 14 is first angulating joint 16. First angulating joint 16 permits the first arm 20 to move in a hinge-like motion around a generally horizontal axis, such that first arm 20 travels between a horizontal orientation and a vertical orientation (with up to approximately 180 degrees total range of motion).

In this version, a pair of sleek illumination control buttons 18 are provided on the upper surface of the first arm 20. Depressing one or the other of these buttons will increase or decrease the light intensity generated by the lamp 10. In other versions, touch-sensitive pads (i.e. solid-state) may be employed.

The first arm 20 terminates at its distal end in second angulating joint 22. This is also where second arm 24 attaches to the first arm 20. Like the first angulating joint 20, the second angulating joint 22 allows the second arm 24 to pivot around a generally horizontal axis, with up to approximately 180 degrees total range of motion.

The lamp arm 28 extends from articulating assembly 26. This lamp 10 version has six light elements 30 dispersed in spaced relation along the face 31 of the lamp arm 28. These light elements 30 happen to be recessed LED clusters having conical baffles extending from each LED cluster to the face 31 of the light arm 28. Of course, other versions could be provided, depending upon the particular application or intended use for the lamp 10.

A critical part of the lamp 10 of the present invention is the articulating assembly 26 because it allows for previously-unavailable range of motion in such a aesthetically pleasing package. The articulating assembly 26 interconnects the second arm 24, and enables the lamp arm 28 to undergo the following motion:

R1—since there are no wires passing through this connection, there is unlimited rotation of the assembly 26 around an axis parallel with the longitudinal axis of the second arm 24;

A—angular motion relative to the second arm 24, with up to approximately 200 degrees total range of motion; and R2—as with R1, unlimited rotation of the lamp arm 28 around an axis parallel with the longitudinal axis of the lamp arm 28.

It is noted that other combinations of arms, joints and light elements may be used in order to fill the widest range of user needs. As such, the particular orientation and arrangement shown here is simply provided as a single example to demonstrate the attributes of the present invention. We will now turn to FIG. 2 to examine the previously-mentioned elements in more detail.

Figure 2:
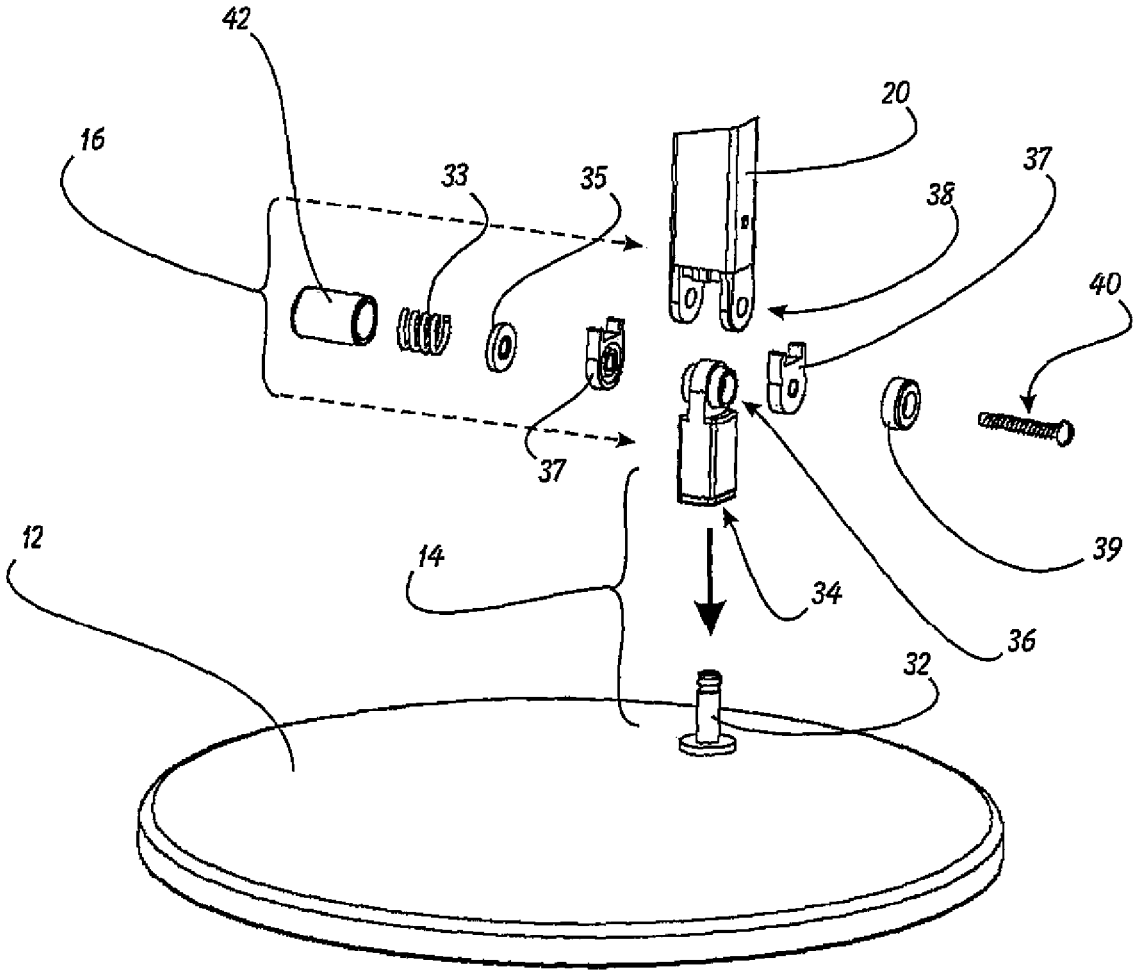
FIG. 2 is a partial exploded perspective view of the base area of the lamp of FIG. 1.

FIG. 2 is a partial exploded perspective view of the base area of the lamp of FIG. 1. The base 12 has a generally cylindrical peg 32 extending from it. The first rotating joint 14 comprises the interface between the peg 32 and the first hinge-half 36. The first hinge-half 36 is formed with a socket 34 configured to accept the peg 32 therein; this interface allows for free rotation between the base 12 and the first hinge-half 36.

The first arm 20 terminates at its proximal end in a second hinge-half 38. The first and second hinge-halves 36 and 38 cooperate with a bolt 40 and nut 42 to form what is essentially a hinge between the first rotating joint 14 and the first arm 20. The combination of these two joints 16 and 14 allows the first arm 20 to rotate and raise/lower relative to the base 12.

The first angulating joint 16 is designed to provide a tight elbow-like connection between the peg 32 and the first arm 20. Since it would be undesirable if the joint 16 required repeated tightening (as some prior art assemblies are know to require). a spring 33 is captured within the joint 16 in order to securely hold the angle at which a user sets the first arm 20. In order to present optimum aesthetics, the nut 42 has a cavity formed within it (not shown) with which the spring 33 resides.

Figure 3:
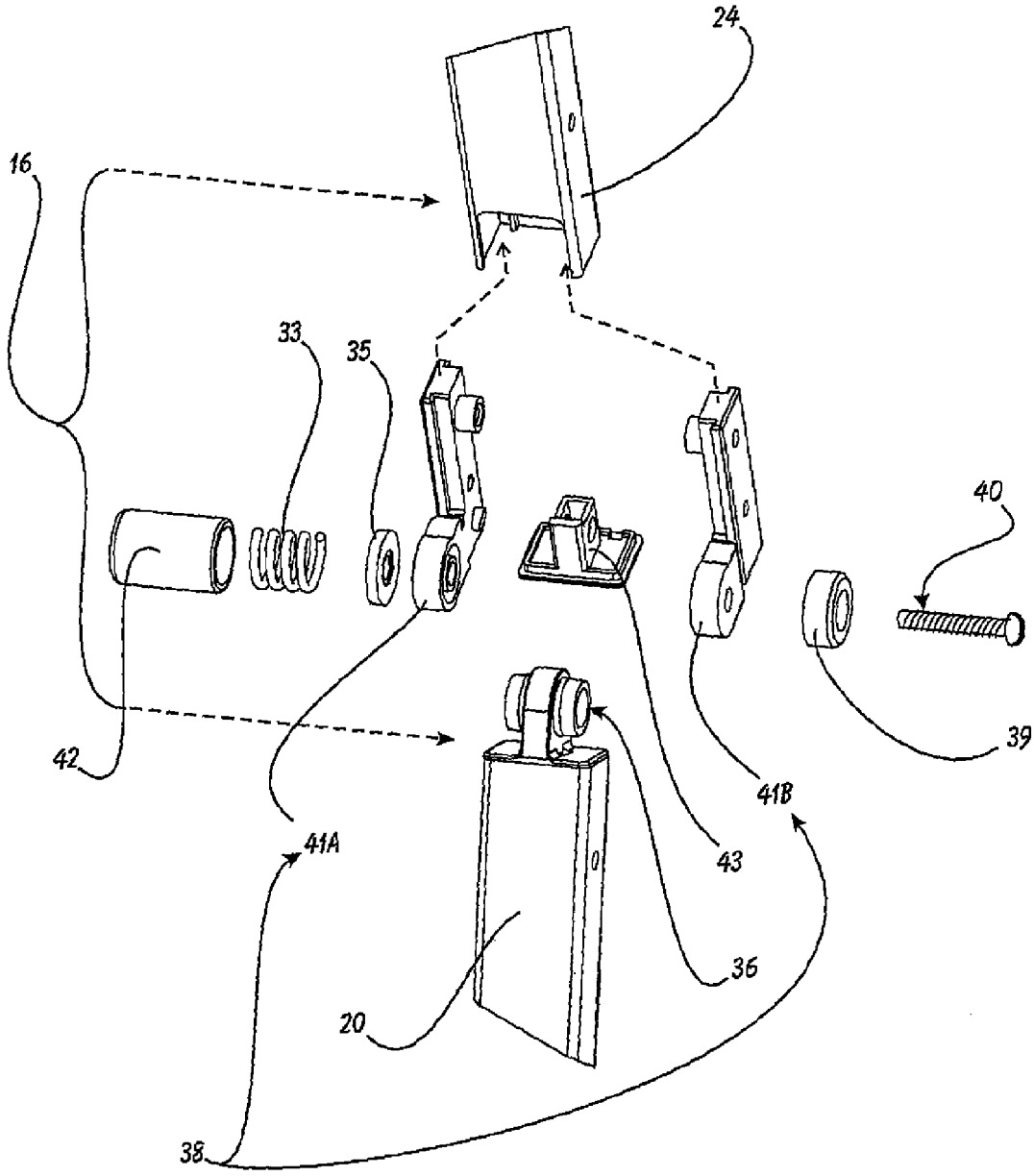
FIG. 3 is an exploded perspective view of the second angulating joint of the lamp of FIG. 1.

A pair of hinge caps 37 bracket the first hinge-half 36; these caps 37 work with the spring 33 to provide the aforementioned holding forces. A washer 35 and spacer 39 are also parts of the assembly comprising the joint 16. FIG. 3 describes the elements of the next joint within the lamp.

Figure 4:
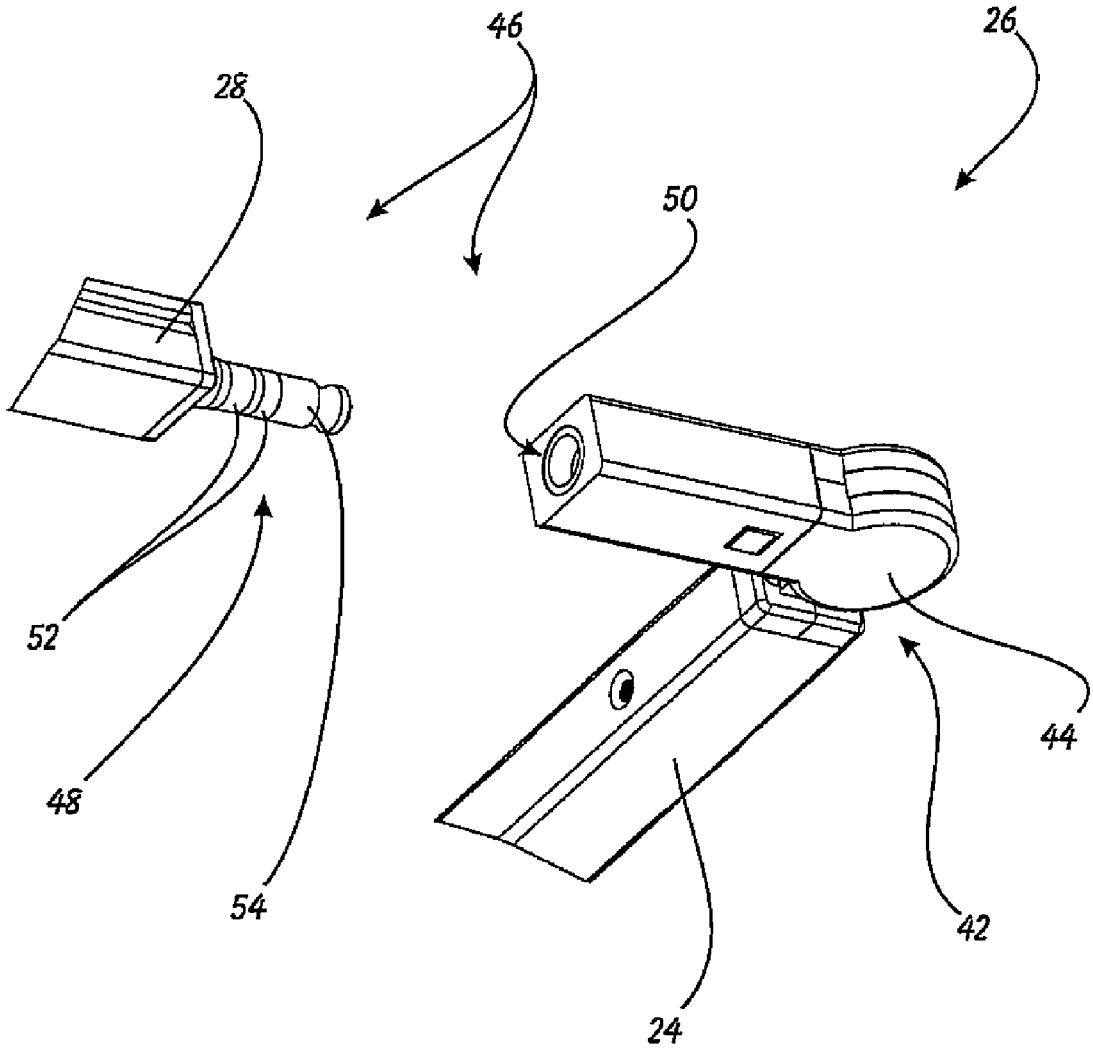
FIG. 4 is a partially exploded perspective view of the articulating assembly of the lamp of FIG. 1.

FIG. 3 is an exploded perspective view of the second angulating joint 32 of the lamp of FIG. 1. The second angulating joint 32 is essentially the same as the first angulating joint (see FIG. 2), however, without the socket for interface with the peg for rotation, and with an offset rotation axis so that the second arm 24 can be folded flat against the first arm 20. The first hinge-half 36 and second hinge-half 38 cooperate with each other and the bolt 40, nut 42, spring 33, washer 35 and spacer 39 (generally the same as the joint 16) to form the second angulating joint 32, which allows rotational or angular movement between the first and second arms 20 and 24. The first and second elbow elements 41A, 41B form the hinge-half 38, and provide the arms with an offset axis of rotation (as related to the longitudinal axis of the first arm) which allows the two arms 20, 24 to be able to be folded together. FIG. 4 provides an initial introduction to the preferred articulating assembly 26.

FIG. 4 is a partially exploded perspective view of the articulating assembly 26 of the lamp of FIG. 1. There are at least two critical aspects to the articulating assembly 26 that are absent from prior lamps. First, there is a rotating joint 46 between the second arm 24 and the lamp arm 28. Second, the lamp arm 28 actually can be snapped in and out of its interconnection with the articulating assembly 26 (without tools). This is particularly valuable because this joint 46 conducts electricity from leads within the second arm 24 for use in the lamp arm 28.

Figure 5:
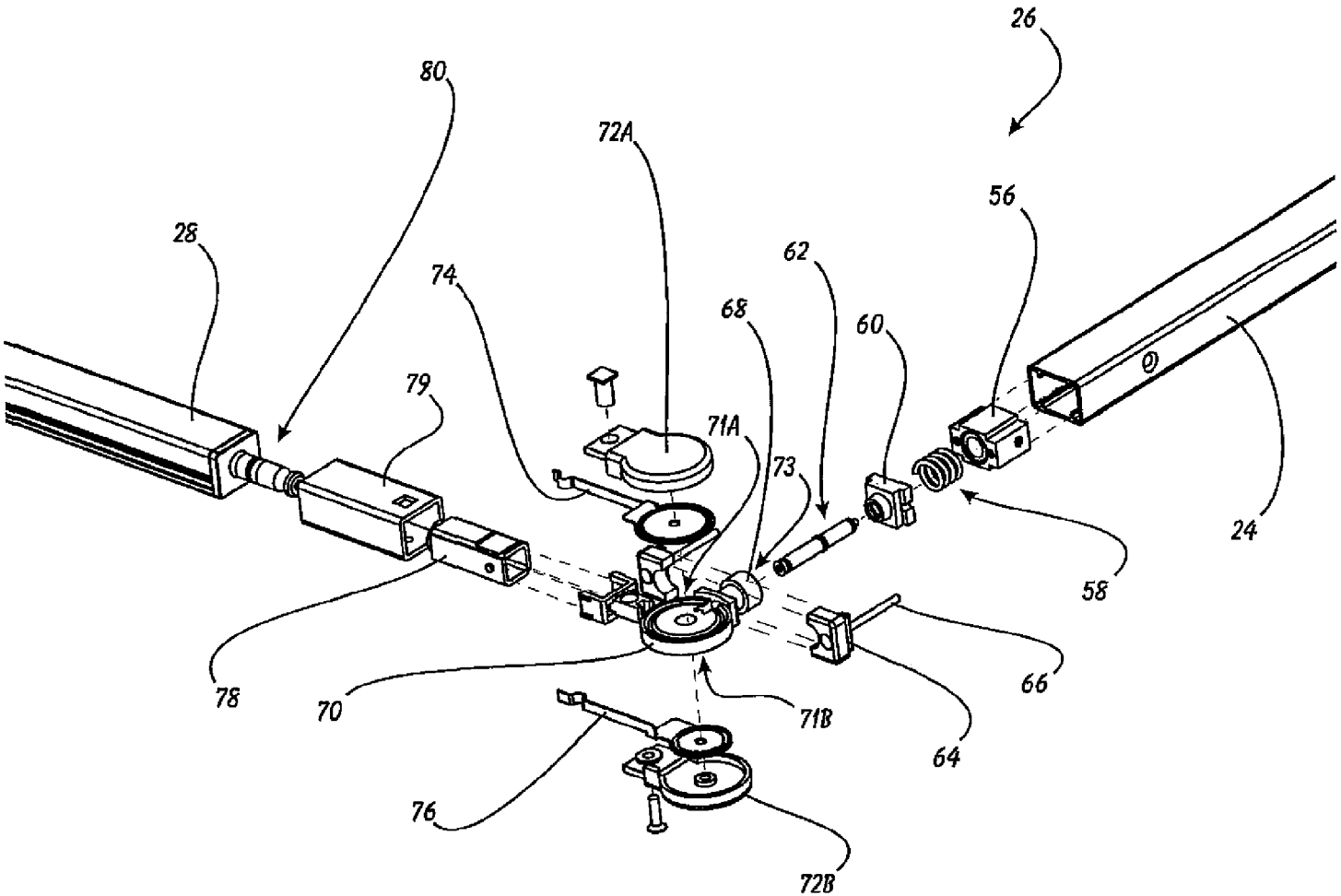
FIG. 5 is an exploded perspective view of the articulating assembly of the lamp of FIG. 1.

The assembly 26 has a conducting socket 50 at its distal end for interfacing with the interlockable conducting peg 48 that extends from the proximal end of the lamp arm 28. The peg 48 comprises a conductive core surrounded by and insulating sleeve, around which are located a pair of electrical contacts 52 spaced along the length of the peg 48 (and having an insulator between them). One of the two contacts 52 is in electrical contact with the conductive core (not shown). The tip 54 is made from non-conducting material (such as nylon or the like), and has a groove formed in it in order to create a positive feature to "click" into the socket 50. When interlocked, the peg 48 will be able to rotate, but will not come out of engagement with the socket 50 until a firm pull is exerted to force the lamp arm 28 away from the socket 50. The detachability of the lamp arm 28 allows for interchangeability of lamp arms 28 (and lighting elements), while the remaining lamp (see FIG. 1) elements remain the same. This advancement is expected to substantially reduce manufacturing costs. FIG. 5 exhibits the articulating assembly 26 in substantial detail.

FIG. 5 is an exploded perspective view of the articulating assembly 26 of the lamp of FIG. 1. Beginning at the second arm 24, an anchor insert 56 is attached within the internal volume of the second arm 24. The insert 56 serves to anchor the second arm 24 to the other elements comprising the articulating assembly 26. The center element 70 has a collar 68 extending from it. The collar 68 engages a pair of finger elements 64. Each finger element 64 has a threaded stem 66 extending from it; when fully assembled, the threaded stems 66 each pass through apertures formed in the anchor insert 56, and are held thereto by nuts or other securing means (not shown).

When the assembly 26 is assembled, the captured conducting peg 62 extends from a socket 73 formed in the center element 70, through the end cap 60, spring 58, and the anchor insert 56. The finger elements 64 and threaded stems 66 hold the anchor insert 56 to the collar 68, and keeps the other elements sandwiched therebetween. The spring 58 biases the end cap 60 away from the anchor insert 56 in order to hold the center element 70 firmly in place, yet still allow rotation around the captured conducting peg 62.

The center element 70 has a first face 71A (on top in this depiction) and a second face 71B. An outer contact element 74, which conducts electricity, is captured between a first housing half 72A and the first face 71A. An inner contact element 76, which also conducts electricity, is captured between a second housing half 72B and the second face 71B. It is noted here that the center element 70, first housing half 72A and second housing half 72B are all non-conductive, and therefore provide insulation between the various electrical conducting elements.

An interface sleeve 79 interconnects the two housing halves 72A and 72B with the lamp arm 28. The interlocking conducting peg 80 releasably locks into a central bore (not shown) formed within the socket element 78. The electrical contacts on the interlocking conducting peg 80 achieve electrical contact with the tips of the two contact elements 74 and 76 when the peg 80 is fitted into the socket element 78. We will now turn to FIGS. 6-9 to discuss various aspects of the assembly 26 in additional detail.

Figure 6:
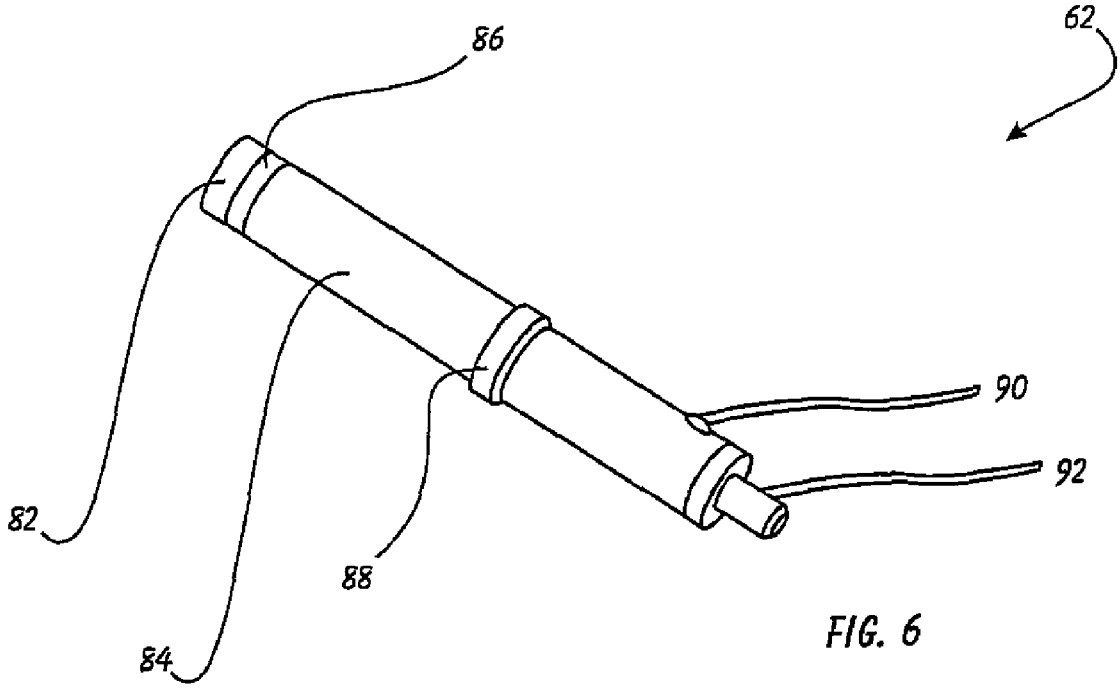
FIG. 6 is a perspective view of the captured conducting peg of the assembly of FIGS. 4 and 5.
Figure 7:
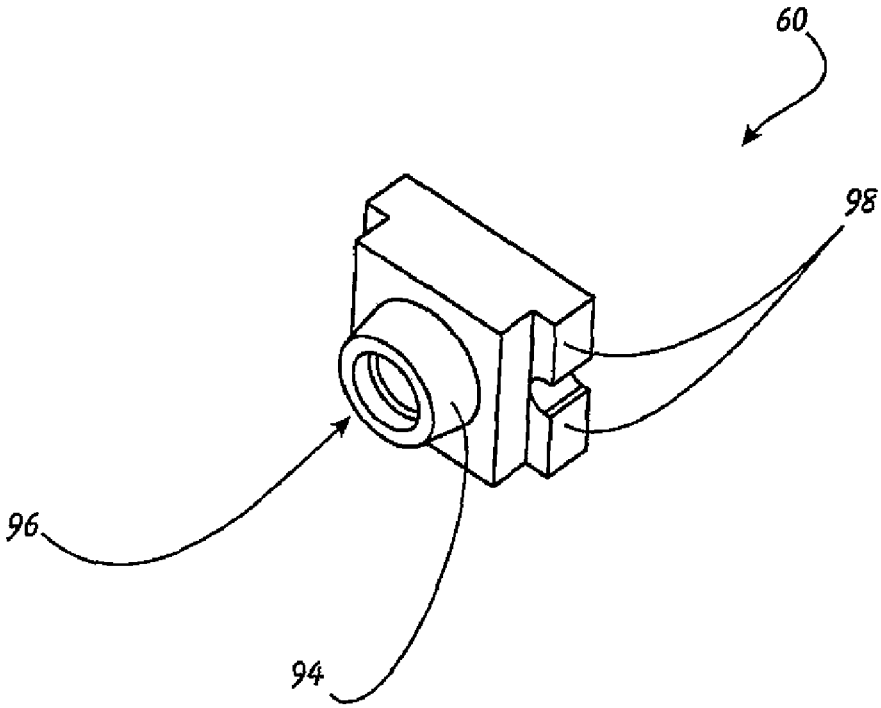
FIG. 7 is a perspective view of the end cap of the assembly of FIGS. 4 and 5.

FIG. 6 is a perspective view of the captured conducting peg 62 of the assembly of FIGS. 4 and 5 and FIG. 7 is a perspective view of the end cap 60 of the assembly of FIGS. 4 and 5. The captured conducting peg 62 (and the other associated elements of the assembly 26 of FIG. 5), like the peg extending from the base (see FIG. 2), permits relative rotation between the adjacent structural members of the lamp. The captured conducting peg 62 has the additional attribute of conducting electricity from the second arm to the lamp arm (see FIG. 5).

The end cap 60 has a bore 96 formed through it to cooperate with the captured conducting peg 62, such that the peg 62 passes through the bore 96. The shoulder 88 on the peg 62 impacts the top face (on the left in this depiction) of the throat 94.

Briefly referring back to FIG. 5, one can see that the spring 58 presses the end cap 60 away from the anchor insert 56, while the finger elements 64, threaded stems 66 and anchor insert 56 resist this biasing force and keep the elements together. The threaded stems 66 threadedly engage the anchor insert 56. The finger elements 64 each engage the collar 68 to create this resisting force. The spring force serves to securely hold the angular position of the articulating assembly 26.

Figure 8:
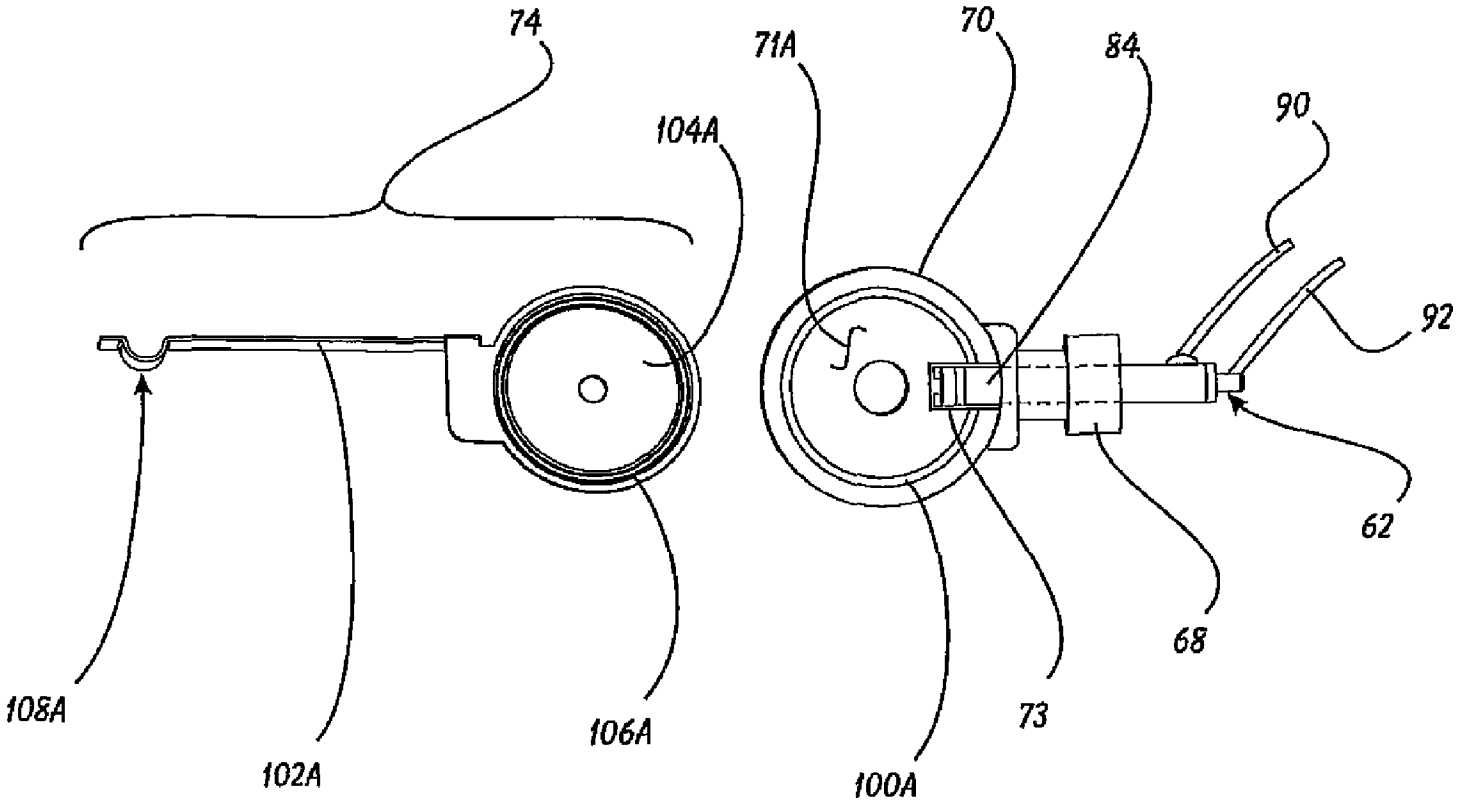
FIG. 8 is a partially exploded top view of portions of the assembly of FIGS. 4 and 5.
Figure 9:
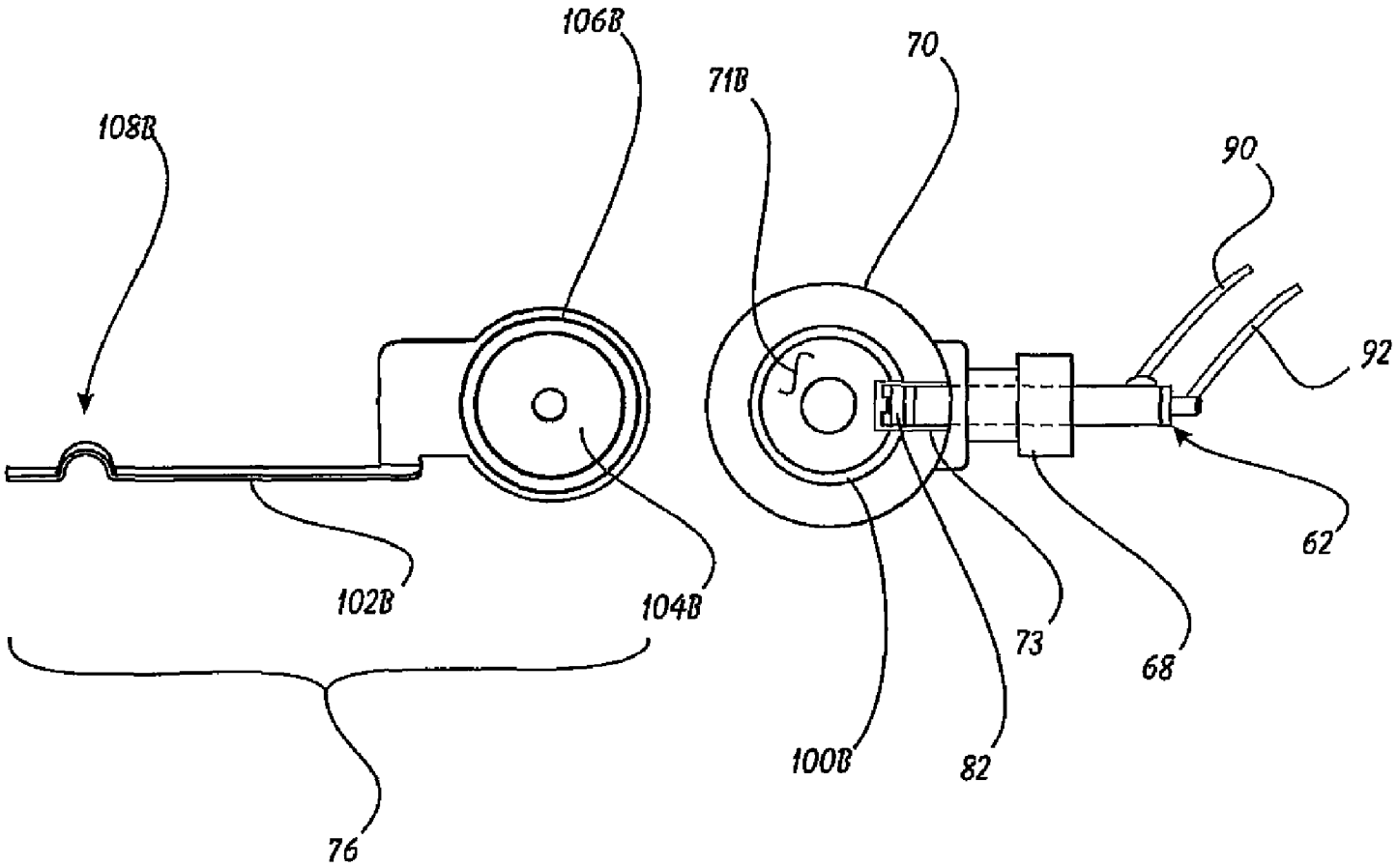
FIG. 9 is a partially exploded bottom view of portions of the assembly of FIGS. 4 and 5.

The peg 62 is defined by two metallic contacts at the end that is inserted into the socket 73 of the center element 70. In this example, the positive contact 82 is at the tip end of the peg 62. A negative contact 84 is located between the shoulder 88 and an insulator strip 86 separating the two contacts 82, 84. The negative contact 84 electrically connected to lead 90. The positive contact 82 is electrically connected to lead 92. Of course, the leads 90 and 92 are connected to the supply power wiring encased within the second arm (see FIG. 1). FIGS. 8 and 9 illuminate the functional aspects of other important components related to the assembly of FIGS. 4 and 5.

FIG. 8 is a partially exploded top view of portions of the assembly, and FIG. 9 is a partially exploded bottom view of portions of the assembly of FIGS. 4 and 5. Specifically, these two drawing figures depict the center element 70 and two contact elements 72, 74, and the other associated elements that allow the assembly (see FIG. 1) to provide hinged motion and rotational motion to the lamp arm (see FIG. 1), while also transmitting electrical power therethrough.

The first face 71A of the center element 70 (on the top in the view of FIG. 5) has a rounded circular groove 100A formed within it, around the entire circumference of the face 71A. The peg 62 is shown here fully inserted into the socket 73 formed in the collar 68. The socket 73 has at least a portion of its length exposed or cut away, so that the contact 84 is exposed. It is noted that the contact 84 is aligned with the groove 100A.

The outer contact element 74 is defined by a contact plate 104A, with a contact arm 102A extending from it. The contact arm 102A has an arm contact ridge 108A formed near its distal end. As discussed in connection with previous drawing figures, the ridge 108A contacts one of the electrical contacts on the interlockable conducting peg (see FIG. 4, elements 52 and 48, respectively).

The contact plate 104A has a circular contact ridge 106A protruding from it. The ridge 106A is shaped and located such that when the outer contact element 74 is placed over the top of the center element 70, the ridge 106A will rest within the groove 100A. As should be apparent, in such a condition, the ridge 106A will also be in contact with the contact 84, thereby making an electrical connection between one of the electrical contacts on the interlockable conducting peg (see FIG. 4, elements 52 and 48, respectively), and one of the leads 90, 92 on the peg 62.

Similarly, as depicted in FIG. 9, the second face 71B has a groove 100B formed in it. This groove 100B is radially closer to the center of the face 71B of the center element 70. Correspondingly, the circular contact ridge 106B is formed on the contact plate 104B such that it will reside in the groove 100B when the inner contact element 76 is placed against the second face 71B of the center element 70.

Clearly, the contact 82 is aligned with the groove 100B when the peg 62 is inserted into the socket 73 (the socket 73 having at least a portion of its wall removed to expose that portion of the peg 62 that aligns with the groove 100B). The arm contact ridge 108B, as with the outer contact element of FIG. 8, aligns with one of the electrical contacts on the interlockable conducting peg (see FIG. 4, elements 52 and 48, respectively), such that there is electrical connectivity between the leads in the second arm and the lamp arm (see FIG. 1).

Again, as should be apparent by the arrangement and configuration of the elements, rotation of the inner and outer contact elements 74, 76 with relation to the peg 62 will not interrupt the electrical connectivity between the leads 90 and 92 (and therefore the electrical power being supplied to the lamp arm).

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein. A specific example is that it would be obvious to someone skilled in the art that this design could be used with any number of arms in between the base 12 and lamp 28, e.g. one arm, three arms, even no arms in which case the articulating assembly 26 attaches directly to a base 12. The base 12 does not have to be a weighted base, it could be a clamp (e.g. to clamp to a desk), a wall mount, or a mount that mounts through the surface (e.g. a through-table mount).

What is claimed is:

1. An electrically conducting articulating joint, comprising:

a center element defined by opposing first and second faces in relative spaced relation, said center element further comprising a socket formed therein, said socket defining openings to said first and second faces at a first end and a third opening at a second end;

a first contact element having a first contact plate and a first contact arm extending therefrom, said first contact element in juxtaposition with said first face;

a second contact element having a second contact plate and a second contact arm extending therefrom, said second contact element in juxtaposition with said second face; and a pair of housing halves, each said housing half attached to one said contact element.

2. The joint assembly of claim 1, wherein said center element, said first contact plate, said second contact plate and said housing halves define a common axis of rotation, whereby said center element can rotate around said common axis relative to said housing halves and said contact plates.

3. The joint assembly of claim 2, further comprising a captured conducting peg inserted into said socket, said peg comprising a pair of electrical contacts adjacent to one end of said peg, one said contact cooperatively located along said peg such that it makes contact with said first contact element, the other said electrical contact cooperatively located along said peg such that it makes contact with said second contact element.

4. The joint assembly of claim 3, wherein said captured conducting peg is defined by first and second leads extending from a second end of said captured conducting peg, said first lead in electrical contact with one said electrical contact, said second lead in electrical contact with the other said electrical contact.

5. The joint assembly of claim 4, wherein said center element first face has a first circular groove formed in it, said first groove radial diameter corresponding to one said electrical contact on said captured conducting peg when said captured conducting peg is inserted into said socket.

6. The joint assembly of claim 5, wherein said center element second face has a second circular groove formed in it, said second groove radial diameter corresponding to the other said electrical contact on said captured conducting peg when said captured conducting peg is inserted into said socket.

7. The joint assembly of claim 6, wherein said first contact plate and said second contact plate have a first circular contact ridge and a second circular contact ridge, respectively, protruding from the surfaces thereof, said first and second circular contact ridges defining radial diameters corresponding respectively to said first and second groove radial diameters, and configured to each cooperate with one said electrical contact on said captured conducting peg whereby electrically conductive connection is made between said cooperating electrical contacts and contact ridges when said captured conducting peg is inserted into said socket.

8. The joint assembly of claim 7, wherein said first and second contact arms are defined by first and second contact ridges protruding from said respective contact arms.

9. A lamp device, comprising:

a lamp arm having one or more light assemblies housed therein, said lamp arm further comprising an interlockable conducting peg extending therefrom;

an electrically conducting articulating joint assembly extending from a base member, said base member selected from the group of a weighted base, a clamp, a through-table mount, or a wall mount, said joint assembly having an interlocking socket for releasably accepting said interlockable conducting peg therein; and wherein said joint assembly further comprises:

a captured conducting peg inserted into a second socket, said peg comprising a pair of electrical contacts adjacent to one end of said peg, one said contact cooperatively located along said peg such that it makes contact with a first contact element, the other said electrical contact cooperatively located along said captured conducting peg such that it makes contact with a second contact element;

said second socket being formed in a center element defined by opposing first and second faces in relative spaced relation, said second socket defining openings to said first and second faces at a first end and a third opening at a second end; and wherein each said contact element is positioned adjacent to one said first and second face.

10. The lamp device of claim 9, further comprising:

an articulating arm for supporting said lamp and providing electrical power thereto, the arm comprising:

a first arm rotatably attached to said base member;

said electrically conducting articulating joint assembly extending from said first arm, said joint assembly having an interlocking socket for releasably accepting said interlockable conducting peg therein.

11. The lamp device of claim 10, further comprising:

said articulating arm comprises a second arm pivotally attached to said first arm; and said electrically conducting articulating joint assembly extends from said second arm.

12. The lamp device of claim 11, wherein said electrically conducting articulating joint assembly comprises:

a center element defined by first and second faces in relative spaced relation, said center element further comprising a socket formed therein, said socket defining openings to said first and second faces at a first end and a third opening at a second end;

said first contact element having a first contact plate and a first contact arm extending therefrom, said first contact element in juxtaposition with said first face;

said second contact element having a second contact plate and a second contact arm extending therefrom, said second contact element in juxtaposition with said second face; and a pair of housing halves, each said housing half attached to one said contact element.

13. The lamp device of claim 12, wherein said center element, said first contact plate, said second contact plate and said housing halves define a common axis of rotation, whereby said center element can rotate around said common axis relative to said housing halves and said contact plates.

14. The lamp device of claim 13, wherein said captured conducting peg is defined by first and second leads extending from a second end of said captured conducting peg, said first lead in electrical contact with one said electrical contact, said second lead in electrical contact with the other said electrical contact.

15. The lamp device of claim 14, wherein said center element first face has a first circular groove formed in it, said first groove radial diameter corresponding to one said electrical contact on said captured conducting peg when said captured conducting peg is inserted into said socket.

16. The lamp device of claim 15, wherein said center element second face has a second circular groove formed in it, said second groove radial diameter corresponding to the other said electrical contact on said captured conducting peg when said captured conducting peg is inserted into said socket.

17. The lamp device of claim 16, wherein said first contact plate and said second contact plate have a first circular contact ridge and a second circular contact ridge, respectively, protruding from the surfaces thereof, said first and second circular contact ridges defining radial diameters corresponding respectively to said first and second groove radial diameters, and configured to each cooperate with one said electrical contact on said captured conducting peg whereby electrically conductive connection is made between said cooperating electrical contacts and contact ridges when said captured conducting peg is inserted into said socket.

18. The lamp device of claim 17, wherein said first and second contact arms are defined by first and second contact ridges protruding from said respective contact arms, said first and second contact ridges configured to each cooperate with one electrical contact disposed on said interlockable conducting peg to provide electrical power to said lamp arm from said articulating arm.

19. The lamp device of claim 18, wherein said electrically conducting articulating joint assembly comprises:

a captured conducting peg residing in said socket, extending between said first arm or said second arm and said socket;

a pair of finger elements engaging opposite sides of a collar feature formed around said socket;

threaded stems extending between said finger elements and an anchor insert inserted into said first arm or said second arm;

a biasing member biasing said collar away from said first arm or said second arm; and an end cap positioned between said collar and said biasing member.

* * * * *